US009190034B2

(12) United States Patent
Fortmuller

(10) Patent No.: US 9,190,034 B2
(45) Date of Patent: Nov. 17, 2015

(54) METAL-EDGED PLECTRUM AND METHOD OF MANUFACTURE THEREOF

(71) Applicant: Joseph A. Fortmuller, Dunedin, FL (US)

(72) Inventor: Joseph A. Fortmuller, Dunedin, FL (US)

( * ) Notice: Subject to any disclaimer, the term of this patent is extended or adjusted under 35 U.S.C. 154(b) by 0 days.

(21) Appl. No.: 14/622,297

(22) Filed: Feb. 13, 2015

(65) Prior Publication Data

US 2015/0154946 A1 Jun. 4, 2015

Related U.S. Application Data

(63) Continuation of application No. PCT/US2013/055129, filed on Aug. 15, 2013.

(60) Provisional application No. 61/683,888, filed on Aug. 16, 2012.

(51) Int. Cl.
*G10D 3/16* (2006.01)
*C23C 28/00* (2006.01)

(52) U.S. Cl.
CPC ..... *G10D 3/163* (2013.01); *C23C 28/00* (2013.01)

(58) Field of Classification Search
CPC ..... G10D 3/163
See application file for complete search history.

(56) References Cited

U.S. PATENT DOCUMENTS 2,052,405 A * 8/1936 Keller ..... A63H 5/00 446/418
5,194,680 A * 3/1993 Reineck ..... G10D 3/163 84/320
5,894,097 A * 4/1999 Barry ..... G10D 3/163 84/322
7,265,285 B2 9/2007 Storey
7,812,234 B2 10/2010 Dybas
7,956,264 B2 * 6/2011 Risolia ..... G10D 3/163 84/320
8,076,560 B2 12/2011 McKee
8,395,038 B2 * 3/2013 Smith ..... G10D 3/163 84/322
9,147,382 * 9/2015 Holm ..... G10D 3/163
2008/0163737 A1 * 7/2008 Grant ..... G10D 3/163 84/320
2008/0163739 A1 7/2008 Grant
2013/0092008 A1 * 4/2013 Murphy ..... G10D 3/163 84/322
2014/0202309 A1 * 7/2014 Gauthier ..... G10D 3/163 84/320
2015/0154946 A1 * 6/2015 Fortmuller ..... C23C 28/00 84/322

OTHER PUBLICATIONS

International Search Report and Written Opinion for PCT/US2013/055129 (filed: Aug. 15, 2013) with a mailing date of Nov. 8, 2013; Applicant: Joseph A. Fortmuller.
International Preliminary Report of Patentability for PCT/US2013/055129 (filed: Aug. 15, 2013) with a mailing date of Feb. 26, 2015; Applicant: Joseph A. Fortmuller.

* cited by examiner

*Primary Examiner* — Robert W Horn
(74) *Attorney, Agent, or Firm* — Smith & Hopen, P.A.; Nilay J. Choksi

(57) ABSTRACT

A plectrum or guitar pick and method of manufacture thereof. The plectrum has one or more metal edges that are substantially flush/planar with the body of the plectrum. This edge may be an outer edge of the plectrum itself or an inner edge of a cutout punched into the body of the pick. Alternatively, metal can be plated onto the body of the plectrum. The body of the plectrum may be formed of a metal, plastic or other suitable material. The interior of the body may contain customized designs, print, or cutouts that contain metal. The metal edge of the plectrum is capable of being flush with the body through a novel method of manufacturing plectra on metallic (e.g., copper clad) boards. Thus, the body and edges of the plectrum may remain coplanar as if created from the same material, though retaining benefits of being formed of two separate materials.

22 Claims, 5 Drawing Sheets

METAL-EDGED PLECTRUM AND METHOD OF MANUFACTURE THEREOF

CROSS-REFERENCE TO RELATED APPLICATIONS

This nonprovisional application is a continuation of and claims priority to prior filed International Application PCT/US2013/055129, entitled "Metal-Edged Plectrum and Method of Manufacture Thereof, filed Aug. 15, 2013 by the same inventor, which claims priority to U.S. Provisional Application No. 61/683,888, entitled "Metal-Edged Plectrum and Method of Manufacture Thereof", filed Aug. 16, 2012 by the same inventor, both of which are incorporated herein by reference in their entireties.

BACKGROUND OF THE INVENTION

1. Field of the Invention

This invention relates, generally, to guitar picks. More particularly, it relates to plectra or guitar picks with flush metal edges.

2. Description of the Prior Art

Guitar picks, or plectra, are very well-known in the art, and various types have been in the art for hundreds of years. Various shapes of guitar picks have been created as well, for example rounded isosceles triangle, equilateral triangle, more-rounded tear drop, or ovular shape, each of which has parallel opposed surfaces adapted for holding between a thumb and forefinger. Guitar picks also have varying thicknesses, typically between about 0.02 inches to about 0.06 inches, depending on the composition and intended use of the pick. Thinner picks can have higher flexibility typically used with thinner strings, and thicker picks can have lower flexibility typically used with thicker strings (e.g., bass guitar). Musicians are continually searching extensively for the optimal shape, material(s), configuration of materials, etc. to provide the best possible sound.

Conventional picks are composed of wood, plastic (e.g., celluloid, nylon, acetal, ultem, lexan, acrylic, delrex, delrin, polyethylene), metals, glass and other materials, such as agate, new tortis, felt, and PHD. Of course, each composition has its strengths and weaknesses. For example, plastic is resilient and is typically used on non-metallic strings. However, resilient picks do not provide the musician knowledge of the precise placement of the pick and plucking of the strings (i.e., lower accuracy) while playing because of how flexible they are, as they do not return to "rest" position as quickly. Softer materials further wear out more quickly, even within a single use, thus interfering with picking accuracy and tone.

Hard metals have been used, typically with metallic strings, for precision plucking of the strings on electrical guitars and similar instruments. However, picks fully formed of metals do not produce optimum sound quality, and because of its composition typically do not have a rounded edge on the pick. Additionally, a pick formed of hard (or even some soft) metals (e.g., U.S. Pat. No. 5,194,680 to "Reineck") does not have the flexibility of other materials and tend to wear down the surface of pick guards, guitar tops, and fretboards.

Attempts have been made to have softer material bodies with metal edges. U.S. patent application Ser. No. 11/651,195 to "Grant" describes an ovular guitar pick with a raised metal tip along its leading edge. Essentially, metal is disposed in overlying relation to the edge of the guitar pick and thus are not coplanar. Though the metal tip may provide a better quality sound when striking the guitar strings, the raised edge leads to a heightened weight imbalance of the pick, thus leading to a higher degree of mistakes and complications, due to the offset weight and tangling with the strings, among other reasons. Placing a metal tip in overlying relation to the opposite end of the guitar pick may balance the weight in the direction of the metal tips, but the pick would still be imbalanced in other directions, which may affect how a user holds the pick when in use. Disposing metal along the entirety of the outer edge of the pick may alleviate the imbalance, but then the pick becomes rather heavy (leading to lower sound quality and increased wear and tear instrument, as explained), and the raised edge all around the pick leads to inaccurate strumming and inability for the user to use a soft pick, thus requiring the user to have multiple picks potentially even during a single use.

Two commercially-available guitar picks claim to have metal edges but also suffer from similar drawbacks. The Dava Master Control Nickel Silver Guitar Pick uses a plastic housing with a punched piece of metal within one of its edges. The Clayton ZZ-Zinc Guitar Pick is completely made of metal (zinc) with a coat of paint (epoxy) on it to give the illusion that the pick is two different materials.

All referenced publications are incorporated herein by reference in their entireties. Furthermore, where a definition or use of a term in a reference, which is incorporated by reference herein is inconsistent or contrary to the definition of that term provided herein, the definition of that term provided herein applies and the definition of that term in the reference does not apply.

Accordingly, what is needed is resilient-bodied, non-resilient-edged plectrum that contains flush barriers between the body and edge to provide optimum sound quality, while maximizing a user's ease of use. However, in view of the art considered as a whole at the time the present invention was made, it was not obvious to those of ordinary skill in the field of this invention how the shortcomings of the prior art could be overcome.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for an improved plectrum and method of manufacture thereof is now met by a new, useful, and nonobvious invention.

In an embodiment, the current invention is a plectrum or guitar pick. The plectrum includes generally planar upper and lower surfaces that opposed to, concentric with, and parallel to each other. A plurality of outer edges connect the upper and lower surfaces and define the spatial boundaries of the plectrum. The upper and lower surfaces define the base and contact portions of the plectrum. The base portion is formed of a first material, and the contact portion is formed of a second material, where the first and second materials could be the same or different. Regardless, the second material forming the contact portion includes a metal in its outermost layer, such that the metal is exposed to the external environment, i.e., the metal is what contacts the strings when operating the instrument. The upper surface of the base portion is substantially planar/flush with the upper surface of the contact portion (plated with metal), and the lower surface of the base portion is substantially planar/flush with the lower surface of the contact portion (plated with metal). Thus, the base portion and contact portion have a substantially common thickness.

The contact portion may be one (1) edge of the plurality of outer edges, such that the metal is disposed along that one (1) edge. Alternatively, the contact portion may include each outer edge, such that metal is disposed at least partially along each outer edge.

The metal on the outer edge(s) may include tin, copper, a combination of tin and copper, or other suitable metal.

The base portion may include fiber glass.

The base portion may include a cutout punched therethrough to facilitate the user gripping the base portion during use. Further, the cutout would have a plurality of inner edges, and these inner edges may also be metal-plated, similar to the outer edge(s). Thus, the metal-plated inner edge(s) would be substantially planar/flush with the base portion in a similar manner.

The contact portion may include one or more outer edges that are beveled, for example at a thirty (30) or forty-five (45) degree angle.

In a separate embodiment, the current invention is a plectrum or guitar pick. The plectrum includes generally planar upper and lower surfaces that opposed to, concentric with, and parallel to each other. A plurality of outer edges connect the upper and lower surfaces and define the spatial boundaries of the plectrum. The upper and lower surfaces define the base and contact portions of the plectrum. A cutout is formed within the base portion and extends through the upper and lower surfaces. This cutout becomes a grip portion that has a plurality of inner edges that line the spatial boundaries of the cutout. The base portion is formed of a first material, and the grip portion is formed of a second material, where the first and second materials could be the same or different. Regardless, the second material forming the grip portion includes a metal in its outermost layer, such that the metal is exposed to the external environment, i.e., the metal is what contacts the user when the plectrum is in use. The upper surface of the base portion is substantially planar/flush with the upper surface of the grip portion (plated with metal), and the lower surface of the base portion is substantially planar/flush with the lower surface of the grip portion (plated with metal). Thus, the base portion and grip portion have a substantially common thickness.

The grip portion may be one (1) edge of the plurality of inner edges, such that the metal is disposed along that one (1) edge. Alternatively, the grip portion may include each inner edge, such that metal is disposed at least partially along each inner edge.

The metal on the inner edge(s) may include tin, copper, a combination of tin and copper, or other suitable metal.

The base portion may include fiber glass.

The base portion may include a plurality of outer edges that are lined or plated with metal, where the metal would be substantially planar/flush with the top and bottom surfaces of the remainder of the base portion. Further, one or more of these outer edges may be beveled, for example at a thirty (30) or forty-five (45) degree angle.

In a separate embodiment, the current invention is a method of fabricating or manufacturing a plectrum or guitar pick. A base copper clad laminate panel is provided, where the panel has upper and lower surfaces and is adapted for the formation of the plectrum (e.g., by drilling and cutting at certain areas in preparation). A copper plate is electroplated over top the upper and lower surfaces of the laminate panel. An optical dry film lamination is applied to the panel, thereby exposing the metallic surfaces that result from exposure and development of the dry film lamination into resist. A metal is applied onto the exposed metallic surface, thereby creating the raised metal-plated edge of the plectrum, where this raised edge becomes the contact portion of plectrum. The resist and copper plate are then removed, thereby exposing the base laminate while still maintaining the raised edge of the plectrum. A solder mask is then applied to the exposed base laminate. The solder mask and underlying laminate panel form the base panel of the plectrum. This base portion is substantially planar/flush with the contact portion, such that the upper and lower surfaces of the plectrum become substantially planar and have a plurality of outer edges that include a metal-plated edge.

The metal may include tin, copper, a combination of tin and copper, or other suitable metal.

The base copper clad laminate panel may include fiber glass.

The fabrication/manufacture method may further include beveling an outer edge of the plectrum prior to electroplating the copper plate onto the laminate panel.

The fabrication/manufacture method may further include applying additional solder masks to the exposed base laminate to maximize the planarity of the upper and lower surfaces of the plectrum, particularly between the base and contact portions.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1A:
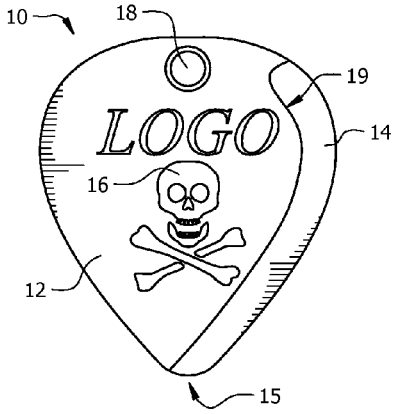
FIG. 1A depicts an embodiment of the current invention having a thicker metal outer edge along one edge of the plectrum.

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

In certain embodiments, the current invention teaches a guitar pick that includes a plurality of outer edges and a body tending away from the outer edges toward the center of the parallel opposed surfaces of the pick. The base of the pick is adapted to be held between the index finger and thumb of the user. The base of the pick may also be imprinted or otherwise designed in a customized manner for the user.

In an embodiment, the body and outer edges of the pick or inner edges of a cutout in the pick's body are contiguous and fully coplanar with minimal to no raised edges. Thus, one or more edges of the pick are formed of a metal, either by plating the edges of the base with metal or forming the entire edge of metal, rather than disposing metal in overlying or surrounding and raised relation to the pick, as seen in the conventional art. It is contemplated that any edge or portion thereof may be formed of metal, so long as the metal portion remains substantially planar with the body of the pick. The customized design on the base of the pick may include imprints (e.g., FIG. 1C) or cutouts (e.g., FIG. 3A) that contain metal as well. In addition to providing aesthetic value, metal or other non-coplanar design on the base can provide lower resilience and/or better grip. For example, metal can outline a cutout in the base of the pick, thus providing aesthetic value and also functionality to reduce the resilience of the base.

Thickness of the metal edge and of the pick's depth is dependent on the needs of the user and desires of the sound produced. The base may be formed of any suitable material, for example plastic, wood, metal and glass. The metal edge or plating may be formed of any metal, for example silver, tin, titanium, gold, chrome, stainless steel, brass, copper, etc. In an embodiment, the metal forming the pick's edge or edge plating is a type that is less resilient than the material forming the base. In a specific embodiment, the base of the pick is formed of fiber glass, and the edge of the pick has a plating formed of tin. In the conventional art, fiber glass has not been used to form plectra, but the current invention has uniquely found that fiber glass produces unexpectedly high sound quality to resonate from the stringed instrument. Tin is also used because it has low cost, manipulable resilience, and high sound quality.

The gauge of each pick can vary depending on the needs of the user. Gauge refers to the size of the pick, materials used (with exception to the base and metal edge(s) having differing materials), width/thickness/height of the pick, weight of the pick, shape of the pick, and edge of the pick (insofar as straight edge, standard bevel, speed bevel, etc.). Size of a pick can affect grip, manipulability (e.g., switching from pick to fingers), and the user's fingers contacting the strings when using the pick. Materials used to form the pick affects the tone produced and durability of the instrument and pick itself. Width of the pick affects accuracy of the user, tone produced from each string, and durability of the pick. Weight of the pick affects the tone produced by the guitar and depends highly on the type and material of strings used.

Shape of the pick can vary from the traditional V- or triangular shape, to ovular and shark-tooth shaped. The shape may affect tone of the music slightly, but it is largely at the discretion of the user for ease of use and aesthetic value. One part of the shape that may be a significant impact on tone and speed is the tip or point of a triangular pick, an end of an ovular pick, and analogous structures. If the tip, point, end, or the like is sharp, the tone typically is edgier; these are used more for speed and percussive palm mutes. If the tip, point, or end is more rounded, the tone is more rounded and strumming may be easier and more accurate; these can be used more for playing longer grooves and when accuracy is of the highest importance.

The edge of the pick impacts speed and tone. If the edge has a speed bevel, then it can be more rounded or "worn in" to promote smoother and faster strumming of the strings. However, a straight edge of standard bevel may be preferred if the user prefers the pick to grab the strings more, rather than slide off the string.

As is evident from the foregoing, the current invention contemplates a variety of factors that are manipulable or customizable in its various embodiments. These factors depend on the needs of the user or manufacturer. Regardless of these factors, the current invention includes a body of the pick formed of one material (e.g., plastic, nylon, acrylic, etc.), where the body has at least one outer edge that is formed of or plated/lined with a metallic material.

It is contemplated that the apparatus of the current invention can be any type of guitar pick, including, but not limited to, flat picks, thumb picks, finger picks, strummers, and hybrid picks. As such, it is contemplated that the metal edge can be located along any outer edge of the pick, or along any edge of a cutout within the base of the pick. For example, in the case of a triangularly-shaped flat pick, the metal edge can be located along any or all legs, bases, base points/angles, and vertex points/angles. As another example, in the case of an elliptically-shaped flat pick, the metal edge can be located along any or all of the circumference, vertices, and co-vertices. As another example, in the case of a thump pick, the metal can be located on the protruding tip atone. As another example, in the case of any pick with a cutout, metal may be located along any or all edges of the cutout, regardless of whether metal is or is not located along the outer edge of the pick itself.

The current invention further contemplates a method of manufacturing guitar picks or plectra, as will become more apparent as this specification continues. Manufacturing guitar picks according to the novel methodology results in guitar picks or plectra with metal edge along the outer edges of the guitar pick itself or along the edges of a cutout within the body of the guitar pick, regardless of whether or not the outer edges of the guitar pick is formed at least partially of metal.

Plectrum Apparatus

The following examples are intended to illustrate various aspects of certain embodiments of the current invention without limiting the scope of the current invention.

Example 1

Figure 1B:
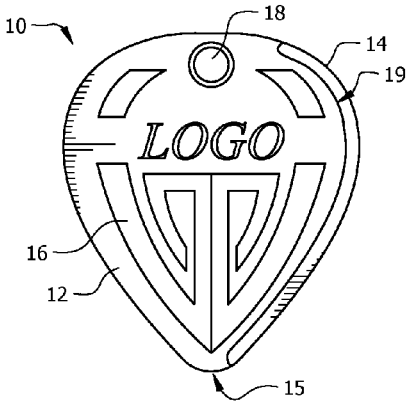
FIG. 1B depicts an embodiment of the current invention having a medium-thickness metal outer edge along one edge of the plectrum.
Figure 1C:
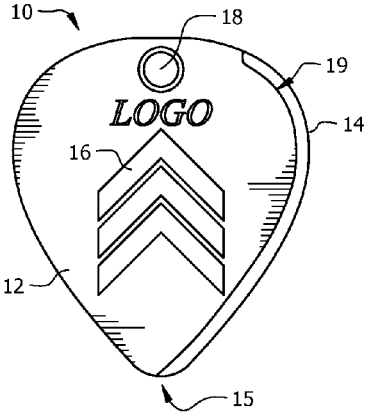
FIG. 1C depicts an embodiment of the current invention having a thinner metal outer edge along one edge of the plectrum.

FIGS. 1A-1C depict various embodiments of the current invention, denoted generally by the reference numeral 10, having base portion 12 and a contact portion with metal disposed along one lateral edge 14 on the opposing parallel surfaces (i.e., upper and lower surfaces) of pick 10. FIG. 1A depicts a thicker metal edge along one lateral edge 14 of pick 10. FIG. 1B depicts a medium-thickness metal edge along one lateral edge 14 of pick 10, and FIG. 1C depicts a thinner metal edge along one lateral edge 14 of pick 10.

The thickness of metal edge 14 is dependent on the needs of the user and the sound desired. A thicker metal edge, as in FIG. 1A, is more heavy-duty and might be more suitable for metal strings since the pick would be thicker (e.g., in depth) and less flexible, whereas a thinner metal edge, as in FIGS. 1B and 1C, is lighter and might be more suitable for non-metal strings since pick 10 would be thinner (e.g., in depth) and more flexible. In each embodiment, metal edge 14 extends in the same manner on the opposite surfaces or sides of pick 10. Because only a single edge is formed of metal, the user has the option of using the material forming base portion 12 on the opposite end to strike the strings if that material is desired.

Figure 2A:
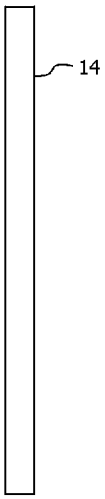
FIG. 2A is a side view of the embodiment of FIG. 1A.
Figure 2B:
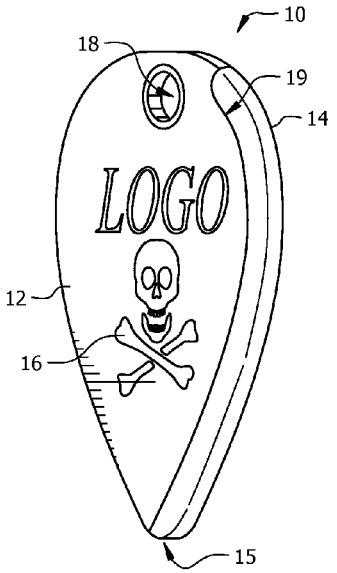
FIG. 2B is a side perspective view of the embodiment of FIG. 1A.

As can be seen in FIGS. 2A-2B, edge 14 of pick 10 and base portion 12 of pick 10 are substantially planar (or flush) at transition point 19. Edge 14 of pick 10 is itself designed and manufactured to be formed of the metal or is uniquely plated with the metal, rather than the metal raised and disposed over top any material that forms base portion 12 of pick 10. As such, pick 10 does not have an uneven weight distribution that causes imprecision in striking the strings. The even weight distribution provides the user with a unique combination of sound quality and control. The unique method of manufacturing this novel pick is described in detail below.

Various other aspects of pick 10 may be present to facilitate the use and maintenance of pick 10. For example, customized design 116 may be included to provide an uneven surface for gripping base portion 12 of pick 10.

Aperture 18 may also be disposed in base portion 12 of pick 10 to maintain pick 10 when not in use.

Any shape of pick 10 is contemplated, though a V-shape is depicted in FIGS. 1A-2B. Regardless of shape, many picks have an apex, generally denoted by the reference numeral 15, that might be used to contact the guitar strings. It is contemplated that apex 15 can be metal-plated, as in FIG. 1A, or may not be metal-plated, as in FIG. 1B, depending on the needs of the user.

Example 2

Figure 3A:
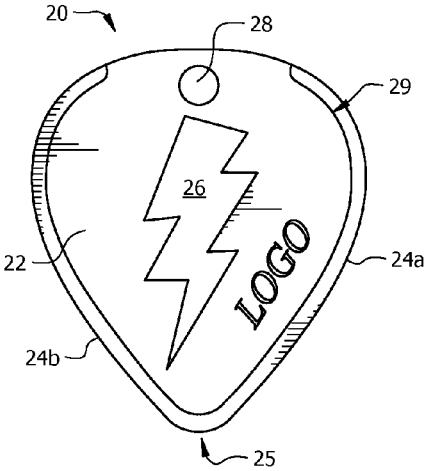
FIG. 3A depicts an embodiment of the current invention with a thinner metal edge along multiple outer edges of the plectrum and a cutout punched out of the base of the plectrum, where the edges of the cutout are not lined or plated with metal.

FIG. 3A depicts an additional embodiment of the current invention, generally denoted by the reference numeral 20, having base portion 22 and a contact portion with metal along both lateral edges 24*a*, 24*b* on the opposing parallel surfaces (i.e., upper and lower surfaces) of pick 20. The metal traverses each edge 24*a*, 24*b* until they intersect at apex 25 or point of the pick. Alternatively, apex 25 may remain free of metal if so desired.

It is contemplated that the thickness of the metal edge may vary, as can be seen in FIGS. 1A-1C. The same considerations must be made when determining material and thickness, for example need of the user, desire of the sound produced, type of strings struck, etc.

In this embodiment, metal edge 24*a*, 24*b* extends in the same manner on the opposite surface or side of pick 20.

Figure 3B:
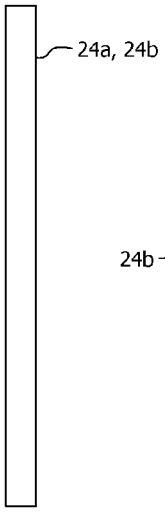
FIG. 3B is a side view of the embodiment of FIG. 3A.
Figure 3C:
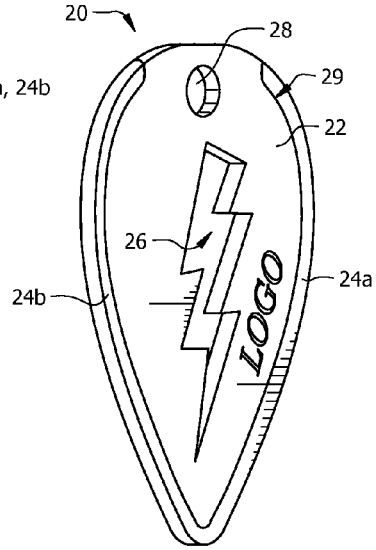
FIG. 3C is a side perspective view of the embodiment of FIG. 3A.

As can be seen in FIGS. 3B-3C, base portion 22 and edges 24*a*, 24*b* of pick 20 are substantially planar/flush at transition point 19. Edges 24*a*, 24*b* of pick 20 are themselves designed and manufactured to be formed of the metal or are uniquely plated with the metal, rather than the metal raised and disposed over top any material that forms base portion 22 of pick 20. As such, pick 20 does not have an uneven weight distribution that causes imprecision in striking the strings. The even weight distribution provides the user with a unique combination of sound quality and control. The unique method of manufacturing this novel pick is described in detail below.

Various other aspects of pick 20 may be present to facilitate the use and maintenance of pick 20. For example, cutout 26 may be included to provide an uneven surface for gripping base portion 22 of pick 20. Cutout 26 is punched out of base portion 22 of pick 20 during manufacture. Cutout 26 may have edges formed of the material used to fabricate base portion 22, as in FIG. 3C, or edges plated with metal, as in FIG. 4.

Aperture 28 may also be disposed in base portion 22 of pick 20 to maintain pick 20 when not in use.

Example 3

Figure 4:
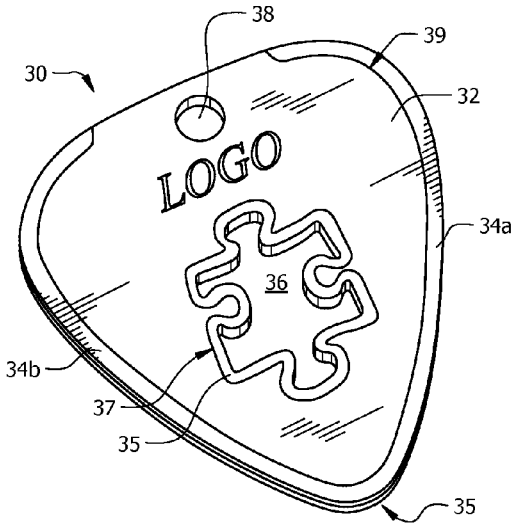
FIG. 4 depicts an embodiment of the current invention having a cutout punched out of the base of the plectrum, where the cutout has edges plated or lined with metal.

FIG. 4 depicts an embodiment of the current invention, generally denoted by the reference numeral 30, where pick 30 includes base portion 32 having cutout 36 therewithin and metal along inner edges 35 of cutout 36 on opposing parallel surfaces (i.e., upper and lower surfaces) of pick 30. In this embodiment, the metal would be plated along edges 35 of cutout 36, regardless of whether outer edges 34*a*, 34*b* of pick 30 is metal-plated, as in Example 1.

FIG. 4 shows metal along outer edges 34*a*, 34*b* of guitar pick 30 and intersecting at apex 35, similar to FIGS. 1A-3C, though in this embodiment, that metal portion can be disposed along only one edge 34*a*, disposed on apex 35, or not present at all. Rather, this embodiment primarily contemplates metal along inner edges 35 of cutout 36 punched out of base portion 32 of pick 30, unlike FIGS. 2A-2B, which include cutout 26 but no metal along the edges of cutout 26.

Cutout 36 with inner metal edge 35 provides benefits for gripping pick 30, and metal edge 35 provides enhanced stability and grip for the user. This may be used by a user who does not wish to have a guitar pick with any metal edges along the outer edges of the pick or have a pick formed entirely of metal but wishes to retain the benefits of metal within the pick. Thus, metal does not contact the guitar strings, but the pick itself retains its benefits of including metal by plating metal within the body of the pick.

It is further envisioned that rather than having a cutout, a metallic design can be plated onto the body of the pick. Thus, metal does not contact the guitar strings, but the pick itself retains its benefits of including metal by plating metal on the body of the pick. The outer edge of the pick may be metal-plated as well, though not required. Placement of metal within the cutout or as a metallic design provides benefits, including, but not limited to, grip, aesthetics, and tonality. The amount and placement of the metal affects the tone produced by the pick.

Base portion 32 and inner edges 35 of cutout 36 are substantially planar/flush at transition point 37. Edges 35 of cutout 36 are themselves designed and manufactured to be formed of the metal or are uniquely plated with the metal, rather than the metal raised and disposed over top any material that forms base portion 32 of pick 30. This is a similar process to what would be seen at transition point 39 if outer edges 34*a*, 34*b* were metal-plated. As such, pick 30 does not have an uneven weight distribution that causes imprecision in striking the strings. The even weight distribution provides the user with a unique combination of sound quality and control. The unique method of manufacturing this novel pick is described in detail below.

Aperture 28 may also be disposed in base portion 22 of pick 20 to maintain pick 20 when not in use.

Example 4

Figure 5A:
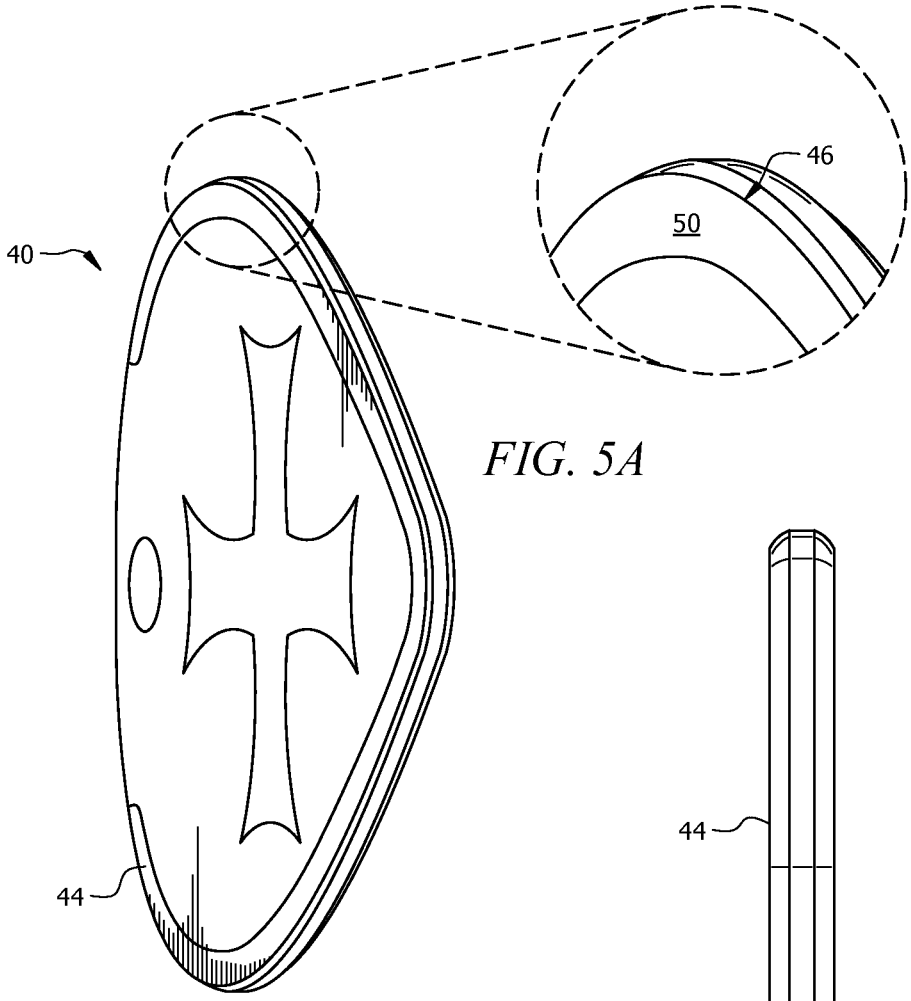
FIG. 5A depicts an embodiment of the current invention having a beveled metal edge.
Figure 5B:
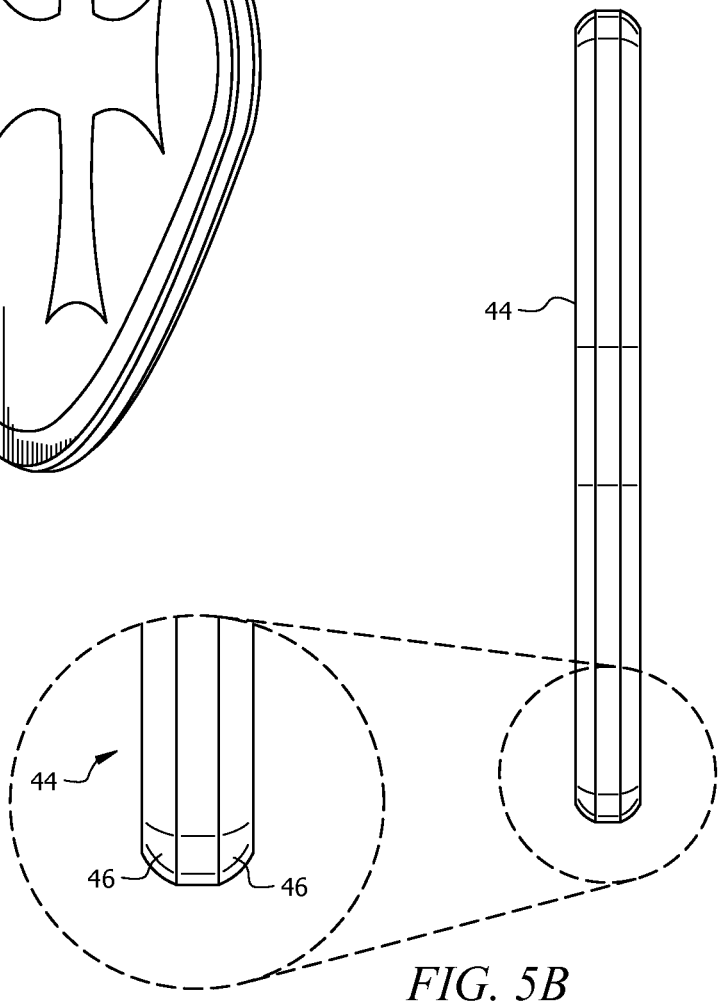
FIG. 5B is a side view of the embodiment of FIG. 5A.

Now referring to FIGS. 5A-5B, certain embodiments of the current invention, generally denoted by the reference numeral 40, include plectrum 40 with metal along at least one edge 44, where the metal edge is beveled 44. The metal edge can be beveled 44 at any angle desired by the user. For example, certain users may prefer the edge of their plectra to be beveled to about a thirty (30) or forty-five (45) degree angle to ease strumming of the guitar strings. Beveled edge 46 makes edge 44 of plectrum 40 more rounded to eliminate or minimize snagging of the strings by plectrum 40.

FIGS. 5A-5B show an approximately 45 degree bevel.

Method of Fabrication

The following examples of fabricating a plectrum according to the current invention are intended to exemplify one embodiment contemplated by the current invention and are not intended to limit the scope of the current invention. Certain steps may be omitted while still resulting in an array of plectra with metal edges along the outer edges of the plectra or metal edges along the outer edges of cutouts within the plectra.

Example 1

Certain embodiments of the current invention are fabricated or manufactured utilizing a novel methodology that results in a printed board containing an array of metal-edged plectra. Each plectrum can be formed of a polymer (e.g., epoxy) laminate that may be glass reinforced or otherwise reinforced if needed to enhance the strength and stability of the polymer or composite material. In an embodiment, the base of the plectrum is formed of a glass epoxy panel including a woven fiberglass cloth with an epoxy resin.

The polymer (e.g., epoxy) laminate can have any suitable insulating laminate grade, such as G10, G11, FR4, FR5, or other grade known in the art. In an embodiment, the laminate can have any or all appropriate characteristics of an FR4 grade material with the main desired functionality being high mechanical strength. For instance, the laminate can have flame-resistant properties, for example by including a halogen, such as a bromine compliant with the restriction of hazardous substances (RoHS) directive, or other suitable element to provide such properties.

The laminate material may further include one or more of the following physical properties: specific gravity 1.80 and moisture absorption (0.062") 0.15%.

The laminate material may further include one or more of the following mechanical properties: Rockwell hardness (0.062") 110 M Scale; flexural strength (0.062") LW (lengthwise, warp yarn direction) 70,000 psi; flexural strength (0.062") CW (crosswise, fill yarn direction) 60,000 psi; flexural modulus (0.062") LW 2,700,000 psi; flexural modulus (0.062") CW 2,400,000 psi; tensile strength (0.125") LW 45,000 psi; tensile strength (0.125") CW 38,000 psi; Izod impact strength E-48/50 (0.500") LW 14.0 ft-lb/in; Izod impact strength E-48/50 (0.500") CW 12.0 ft-lb/in; compressive strength flatwise (0.500") 55,000 psi; bond strength (0.500") 2,200 lbs; shear strength (perpendicular) (0.062") 22,000 psi; Young's modulus LW $3.5\times10^6$ psi; Young's modulus CW $3.0\times10^6$ psi; Poisson's ratio LW 0.136; and Poisson's ratio CW 0.118.

The laminate material may further include one or more of the following thermal properties: maximum operating temperature (284° F.), coefficient of thermal expansion (0.062") X-axis $5.5\times10^{-6}$ in/in/° F., coefficient of thermal expansion (0.062") Y-axis $6.6\times10^{-6}$ in/in/° F., flammability rating—U.L. 94 V-0, coefficient of thermal expansion (CTE) x-axis 14 ppm/° C., CTE y-axis 13 ppm/° C., CTE z-axis 175 ppm/° C. and glass transition temperature can vary though over 248° F.

The laminate material may further include one or more of the following electrical properties: permittivity (0.062") condition D-24/23 4.80; dissipation factor (0.062") condition D-24/23 0.025; breakdown voltage—A 65,000 V; breakdown voltage (0.062") D-48/50 54,000 V; electric strength condition—A 800 V/mil; electric strength (0.062") D-48/50 750 V/mil; arc resistance (0.125") D-495 of 100 sec; comparative tracking index (0.125") D3638 of 150; and Tg 261° F.

The board of plectra can be single-layered or multi-layered for increased output and efficiency. A single-layered board is typically utilized with two (2) layers of copper included in the layer, one (1) below and one (1) above.

Upon fabrication of the polymer laminate, copper foil can be laminated onto one or both sides of the polymer laminate. In an embodiment, the polymer laminate is an FR4 glass epoxy panel, such that a copper clad laminate would form a shear FR4 copper clad sheet. The amount of copper foil laminated onto the polymer laminate can vary depending on needs and thickness of the plectrum. Typically, about one (1) ounce of copper per square foot is needed for each 35 um of thickness. Thus, if the plectrum is seventy (70) um thick, about two (2) ounces per square foot would typically be needed. However, these ratios and amounts can change based on standards in the art.

Once the board is laminated with copper foil, a non-plated aperture can be drilled into each board at the position of each plectrum. The apertures can have any size e.g., 0.125 inches) suitable and known in the art. A thin copper deposit may then be applied in the hole barrels. The board can then be hot air solder leveling finished by dipping the board into a bath of molten lead-free solder, so that all copper surfaces are covered by lead-free solder. The excess lead-free solder can be removed and discarded by any suitable method, for example scraping the board with hot air knives to also level the lead-free solder on the board.

Subsequently, a liquid photoimageable (LPI) solder mask can be placed on each side of the board. The LPI mask can be colored in various manners depending on the needs of the users and/or fabricators. A legend can then be added on each side of the board for designs or logos on each side of each plectrum. Thus, the legend can also be colored in various manners depending on the needs of the users and/or fabricators.

After the primary imaging/developing process has been completed, the edge of each plectrum on the board is electrolytically plated (electroplated) with a metal, such silver, tin, titanium, gold, chrome, stainless steel, brass, copper, or other suitable metal, or a combination thereof.

A clear or colored LPI mask can then be added to both sides prior to final rout.

In certain embodiments, the finished board containing the array of plectra is compliant with the restriction of hazardous substances (RoHS) directive, which restricts the use of lead, mercury, cadmium, hexavalent chromium, polybrominated biphenyls (PBB), and polybrominated diphenyl ether (PBDE). Hexavalent chromium is used in chrome plating and chrome coatings, and PBB and PBDE typically are flame retardant materials used in plastics. Specifically, in order to be RoHS compliant, cadmium and hexavalent chromium should be present at less than 0.01% by weight at raw homogenous materials level. Lead, PBB, and PBDE should be present at less than 0.1% by weight at raw homogenous materials level. Mercury should be present at a level of less than or equal to 100 ppm.

The foregoing methodology, and further details thereof, may be adapted to the design of each type of plectrum, based on the desired gauge of the plectrum.

Example 2

In an embodiment, the steps used to manufacture certain guitar picks or plectra of the current invention include a methodology of fabricating the plectra on a copper clad panel. A shear FR4-grade woven epoxy fiberglass copper clad panel is provided. Apertures are drilled into the panel where each plectrum is desired to be formed. The panel is then routed at the edges of the designed plectra where the metal is to be plated. This may be at the outer edges of the plectra itself and/or the edges of the cutouts within the body of the plectra.

An electroless copper plate is provided over top each plectrum, and an optical dryfilm (plate resist) image transfer is applied to the panel. A light source and film can be used to expose the panel, such that the selected areas on the panel can be developed. Thereafter, an electrolytic metal (e.g., copper and tin) plate is applied to the panel. This electrochemical process helps build copper in the holes and on the trace area, such that tin can be applied to the surface. The dryfilm is stripped/removed off the panel, the exposed copper is etched, and the tin is stripped/removed off the panel.

A primary solder mask is applied to the panel, followed by application of a metal plate to the panel, including the edges of the plectra. A secondary solder mask is then applied to the panel.

Upon primary fabrication of each plectrum on the panel, a silkscreen can be applied to the panel for any customized design of the plectra. The design can be aesthetic or functional to facilitate gripping and use of the plectrum, as desired by the manufacturer or user.

Figure 7:
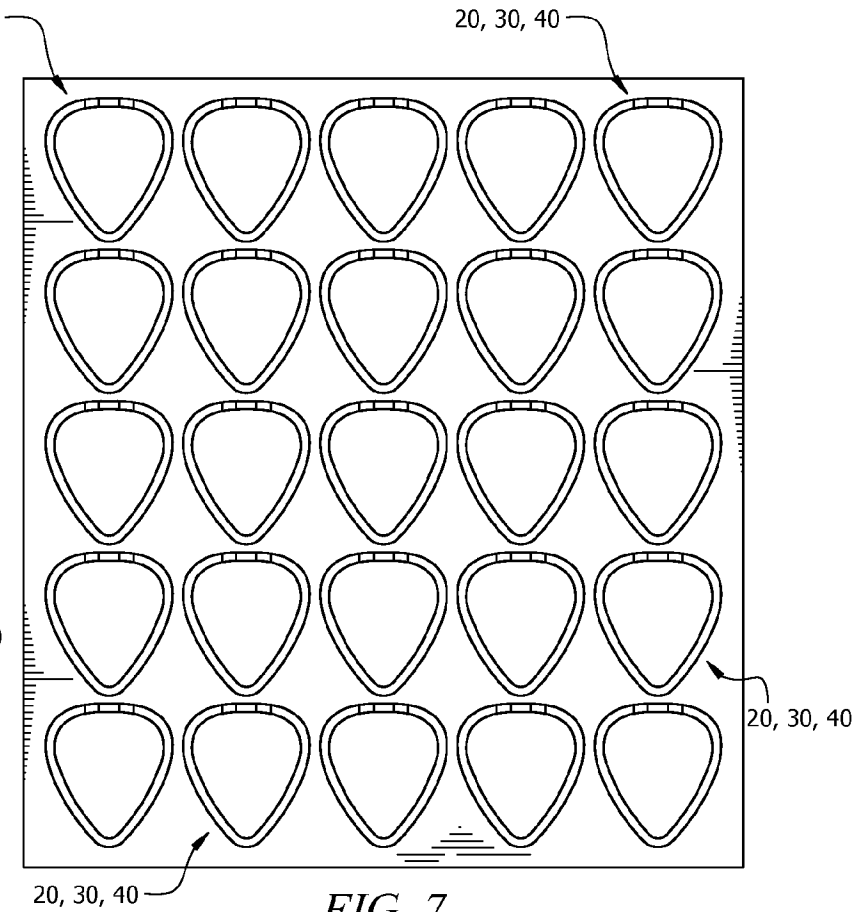
FIG. 7 depicts a board containing an array of plectra resulting from a method of manufacturing plectra according to an embodiment of the current invention, where the plectra have a multiple outer edges lined or plated with metal.
Figure 6:
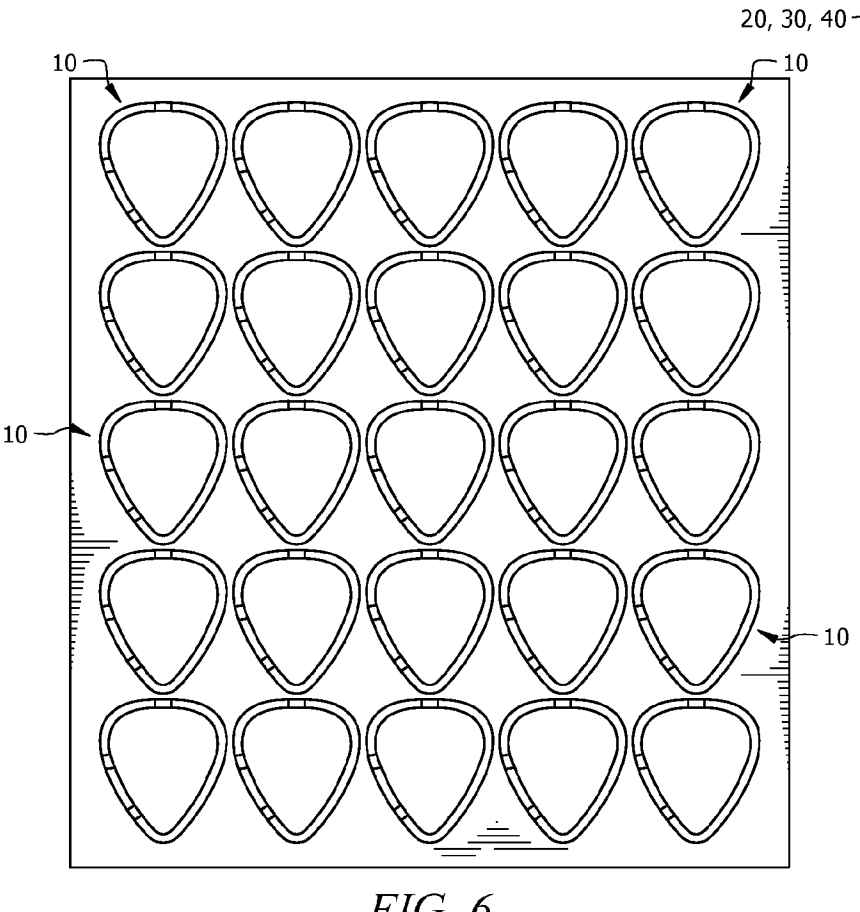
FIG. 6 depicts a board containing an array of plectra resulting from a method of manufacturing plectra according to an embodiment of the current invention, where the plectra have a single metal outer edge lined or plated with metal.

At this point, the panel can be routed to the final shape of each plectrum. Thus, any shape plectrum can be formed, as desired by the manufacturer or user. FIGS. 6 and 7 depict a grid of embodiments of the current invention that can be created utilizing the novel manufacturing method. FIG. 6 shows an array of plectra formed with one metal-plated outer edge, similar to that seen in FIGS. 1A-2B with pick 10. FIG. 7 shows an array of plectra formed with multiple metal-plated outer edges, similar to that seen in FIGS. 3A-5B with pick 20, 30, 40. The plectra can be separated from the panel manually or by machine.

To complete fabrication of the plectra, holes can be deburred on a grinding wheel and on a medium/coarse grit sanding block. The plectra are then sanded manually or by machine on a fine grit sanding block. Ink is then applied to the sanded edges of each plectrum, and the inked plectra are air-dried or otherwise dried.

Planarity

Because of the problems noted in the art with metal-edged guitar picks, in particular the thickness of the metal edge over the remainder of the pick, a goal of the plectra of current invention resulting from the current methodology are generally substantial planarity along each surface of each plectrum. Thus, a user can enjoy the benefits of a metallic contact point (i.e., edge) that contacts the strings and can enjoy a base formed of any material desired without suffering the drawbacks of seen in the prior art. This is achieved using the following methodology.

Holes are drilled into the copper foil through each side of the board, which may be formed of fiberglass or other suitable material with copper in outer relation thereto. If any cutouts are to be included in the resultant plectrum, the surfaces of the board can be deburred to remove any raised edges of the burrs surrounding the drilled holes. The holes are also cleaned out. At this point, the edges of the plectra are beveled (e.g., with 30 degree, 45 degree, etc. bevel) if desired in the resultant product.

The surfaces of the board are then copper-plated with a thin coating of copper chemically deposited on exposed surfaces of the board. The thickness of this copper base may be about 0.0003 inches or other suitable thickness. This plating allows thicker copper (e.g., about 0.0014 to about 0.0028 inches) to electroplate onto the surfaces of the board. An optical dryfilm image is then transferred onto the board/panel, including the drilled holes. The design in copper on the dryfilm is shot onto the base laminate.

After the dryfilm lamination is exposed and developed, the clear areas (i.e., the exposed metal surfaces) on the panel would be the edges of each plectrum or of the cutouts within each plectrum. The remainder would become the resist by hardening from the light passing through the clear areas. At this point, additional electrolytic copper, tin and/or other metal (e.g., copper followed by tin) is electrically plated onto the clear areas, for example at a thickness of about 0.001 inches to about 0.0014 inches.

The areas outside of the metal-plated edges can undergo a strip-etch-strip process. The remainder of the resist (i.e., developed dryfilm resist) is stripped without affecting the electrolytic metal plating on the edges. The thin copper plating can then be etched to reveal the base laminate. Further, the tin can be stripped, exposing a bare copper and laminate panel.

Figure 8:
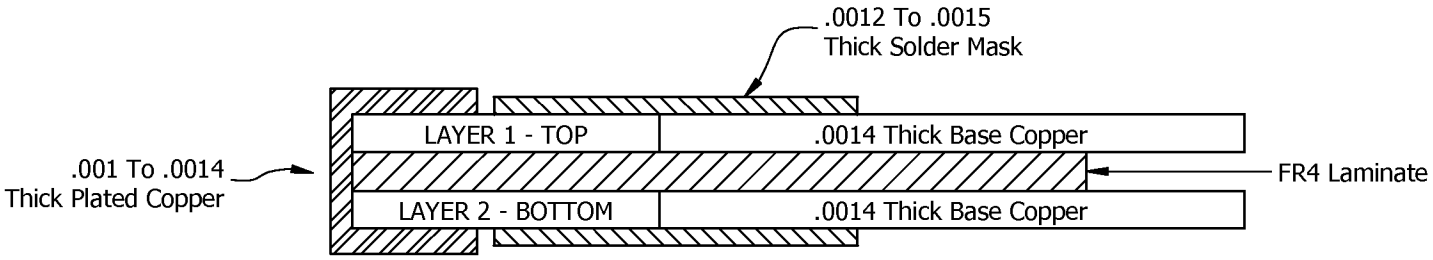
FIG. 8 is a side cross-sectional view of an edge of a plectrum resulting from a manufacturing process according to an embodiment of the present invention, where it can be seen that the thick solder mask and thick plated copper are substantially planar.

This panel is then prepared for the solder masks. The solder is not disposed on the raised copper edge but floods the bare laminate at varying thicknesses, for example about 0.0012 inches to about 0.0015 inches per mask. A white legend of silkscreen is then applied to the panel, followed by hot air solder leveling (i.e., applying solder to everything that is copper). Subsequently, a second solder mask is applied to the panel in the same manner as the first mask, i.e., flooding the areas that are not the raised copper edge at varying thicknesses such as about 0.0012 inches to about 0.0015 inches. Thus, laminate with solder masks become substantially planar with the raised edge. This can be seen in FIG. 8 where the thick solder mask (body) and the thick plated copper (edge) are substantially planar.

In short, this allows the base of the plectra and edge of the plectra to remain substantially planar. The plectra are coated with an approximately 0.0003 inch thick layer of lead-free solder. Upon plating of the plectra edge with metal, the thickness of the metal plating above the remainder of the pick is between about 0.001 and about 0.0014 inches thick. The application of two (2) solder masks increases the thickness of the remainder of the pick by about 0.0012 to about 0.0015 inches. Thus, the approximate 0.0014-0.0028 inch-thick metal edge is substantially planar with the approximately 0.0012-0.0015 inch-thick solder mask. This results in a plectrum that is substantially planar across the top and bottom surfaces of the plectrum.

GLOSSARY OF CLAIM TERMS

Adapted for the formation of a plectrum: This term is used herein to refer to the laminate panel being structured for the fabrication of plectra, for example by drilling apertures at the position of each plectrum and cutting the panel at or near the boundaries of the plectra in preparation for metal plating and soldering.

Base portion: This term is used herein to refer to a body of the plectrum typically used for gripping the plectrum.

Bevel: This term is used herein to refer to an edge that is canted at an angle between zero (0) degrees and ninety (90) degrees. A beveled edge thus provides a more rounded edge that can facilitate operation of the instrument for certain users.

Contact portion: This term is used herein to refer to the aspect of the plectrum that makes primary physical contact with the guitar strings or other instrument. Thus, the material that forms at least a part of the contact portion (here, a metal) makes primary physical contact with the guitar strings or other instrument. As such, part of the contact portion is disposed on the upper surface of the plectrum, part of the contact portion is disposed on the lower surface of the plectrum, and part of the contact portion is the corresponding portion of the outer edge connecting the upper surface and lower surface.

Cutout: This term is used herein to refer to a predesigned empty space disposed within the body of a plectrum, where the empty space extends through the upper and tower surfaces of the plectrum, thus enhancing the grip of the plectrum for certain users.

Edge: This term is used herein to refer to the boundary line of a surface for example the boundary of a plectrum or the boundary of a cutout within the body of a plectrum.

Exposed base laminate: This term is used herein to refer to the remainder of a plectrum that lies below the raised edge of the plectrum during manufacture of the plectrum after the edge of the plectrum is metal-plated to increase its width.

Exposed to the external environment: This term is used herein to refer to the outermost layer of the contact portion of a plectrum.

Grip portion: This term is used herein to refer to an aspect of a plectrum that is designed to facilitate gripping by a user or otherwise designed to be gripped by the user. For example, a cutout punched out of the body of a plectrum does provide aesthetic value desired by a user, but functionally it can also enhance the gripping mechanism of the user. Thus, this portion of the plectrum's body where the cutout is positioned would be the grip portion.

Metal: This term is used herein to refer to the material that plates or lines one or more edges of the plectrum, whether that edge is the outer edges of the plectrum itself and/or inner edges of a cutout punched through the body of the plectrum.

Metal-plated edge: This term is used herein to refer to a boundary line of a plectrum that is lined or plated with a metal.

Raised edge: This term is used herein to refer to a boundary line of a plectrum that has a width greater than the remainder of the plectrum by plating metal on the edge during manufacture of the plectrum. Thereafter, the remainder of the plectrum receives one or more solder masks to become substantially planar with the raised metal-plated edge.

Spatial boundaries: This term is used herein to refer to the physical space taken up by a physical object (e.g., a plectrum) or an absence of a physical object (e.g., cutout within a plectrum).

Substantially planar: This term is used herein to refer to the nature of two aspects of a single plectrum being generally flat in relation to one another when positioned adjacent to one another. The term "substantially" refers to the possibility that the two aspects are not exactly planar, but minimal difference can be present, particularly when observed by the naked eye. For example, the foregoing description of the planarity of each plectrum shows that the difference between the contact portion and the base portion is a fraction of an inch (i.e., to the thousandths degree of an inch). This would be substantially planar, having minimal difference in height between the two aspects.

It will thus be seen that the objects set forth above, and those made apparent from the foregoing disclosure, are efficiently attained. Since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A plectrum or guitar pick, comprising:

a generally planar upper surface and a generally planar lower surface, said lower surface being opposed to said upper surface, said lower surface being concentric with said upper surface, said lower surface being generally parallel to said upper surface; and a plurality of outer edges that connect said upper surface and lower surface, said plurality of outer edges defining the spatial boundaries of said plectrum, said upper surface and said lower surface defining abuse portion and a contact portion;

said base portion formed of a first material, said contact portion formed of a second material, said second material including a metal that is exposed to the external environment, wherein said upper surface of said base portion is substantially planar with said upper surface of said contact portion, and wherein said lower surface of said base portion is substantially planar with said lower surface of said contact portion, such that said base portion and said contact portion have a substantially common thickness.

2. A plectrum or guitar pick as in claim 1, further comprising:

said contact portion being one (1) edge of said plurality of outer edges, such that said metal is disposed along said one (1) edge.

3. A plectrum or guitar pick as in claim 1, further comprising:

said contact portion being each of said plurality of outer edges, such that said metal is disposed along at least a portion of said each outer edge.

4. A plectrum or guitar pick as in claim 1, further comprising:

said metal including tin.

5. A plectrum or guitar pick as in claim 1, further comprising:

said base portion including fiber glass.

6. A plectrum or guitar pick as in claim 1, further comprising:

said base portion including a cutout disposed therethrough to facilitate gripping of said base portion.

7. A plectrum or guitar pick as in claim 6, further comprising:

said cutout having a plurality of inner edges that are lined or plated with an additional metal, wherein said additional metal is substantially planar with said top and bottom surfaces of said base portion.

8. A plectrum or guitar pick as in claim 1, further comprising:

an edge of said plurality of outer edges having a bevel along said contact portion.

9. A plectrum or guitar pick as in claim 8, further comprising:

said bevel being a thirty (30) or forty-five (45) degree angle.

10. A plectrum or guitar pick, comprising:

a generally planar upper surface and a generally planar lower surface, said lower surface being opposed to said upper surface, said lower surface being concentric with said upper surface, said lower surface being generally parallel to said upper surface;

a plurality of outer edges that connect said upper surface and lower surface, said plurality of outer edges defining the spatial boundaries of said plectrum, said upper surface and said lower surface defining a base portion and a contact portion; and a cutout formed within said base portion and extending through said upper surface and said lower surface, said cutout forming a grip portion having a plurality of inner edges that line the spatial boundaries of said cutout, said base portion formed of a first material, said plurality of inner edges of said grip portion formed of a second material, said second material including a metal that is exposed to the external environment, wherein said upper surface of said base portion is substantially planar with said upper surface of said grip portion, and wherein said lower surface of said base portion is substantially planar with said lower surface of said grip portion such that said base portion and said grip portion have a substantially common thickness.

11. A plectrum or guitar pick as in claim 10, further comprising:

said grip portion being one (1) edge of said plurality of inner edges, such that said metal is disposed along said one (1) edge.

12. A plectrum or guitar pick as in claim 10, further comprising:

said grip portion being each of said plurality of inner edges, such that said metal is disposed along at least a portion of said each inner edge.

13. A plectrum or guitar pick as in claim 10, further comprising:

said metal including tin.

14. A plectrum or guitar pick as in claim 10, further comprising:

said base portion including fiber glass.

15. A plectrum or guitar pick as in claim 10, further comprising:

said base portion including a plurality of outer edges that are lined or plated with an additional metal, wherein said additional metal is substantially planar with said top and bottom surfaces of the remainder of said base portion.

16. A plectrum or guitar pick as in claim 15, further comprising:

an edge of said plurality of outer edges having a bevel along said contact portion.

17. A plectrum or guitar pick as in claim 16, further comprising:

said bevel being a thirty (30) or forty-five (45) degree angle.

18. A method of fabricating a plectrum or guitar pick, comprising the steps of:

providing a base copper clad laminate panel having a upper surface and a lower surface, said base laminate panel drilled and adapted for the formation of said plectrum;

electroplating a copper plate in overlying relation to said upper surface of said copper clad laminate and in overlying relation to said lower surface of said copper clad laminate;

applying an optical dry film lamination to said panel, thereby exposing metallic surfaces resulting from exposure and development of said dry film lamination into resist;

applying a metal onto said exposed metallic surfaces, thereby creating a raised metal-plated edge of said plectrum, said raised edge forming a contact portion of said plectrum;

revealing an exposed base laminate by removing said resist and said copper plate, thus maintaining said raised edge of said plectrum; and applying a solder mask to said exposed base laminate, said solder mask and said underlying laminate panel forming a base portion of said plectrum, wherein said base portion of said plectrum is substantially planar with said contact portion of said plectrum, thus creating a substantially planar upper surface of said plectrum and a substantially planar lower surface of said plectrum, such that said base portion and said contact portion have a substantially common thickness, said upper and lower surfaces having a plurality of outer edges that include a metal-plated edge.

19. A method of fabricating a plectrum or guitar pick in claim 18, further comprising:

said metal including tin.

20. A method of fabricating a plectrum or guitar pick in claim 18, further comprising:

said base copper clad laminate panel including fiber glass.

21. A method of fabricating a plectrum or guitar pick in claim 18, further comprising the step of:

beveling an outer edge of said plectrum prior to electroplating said copper plate.

22. A method of fabricating a plectrum or guitar pick in claim 18, further comprising the step of:

applying additional solder masks to said exposed base laminate to maximize planarity of said upper and lower surfaces of said plectrum.

* * * * *